US005123467A

United States Patent [19]

Steinberg

[11] Patent Number: 5,123,467

[45] Date of Patent: Jun. 23, 1992

[54] DIAPERBAG

[75] Inventor: David J. Steinberg, Brooklyn, N.Y.

[73] Assignee: Romar International Corp., New York, N.Y.

[21] Appl. No.: 803,045

[22] Filed: Dec. 6, 1991

[51] Int. Cl.[5] ..... A45C 15/00

[52] U.S. Cl. ..... 150/106; 150/114

[58] Field of Search ..... 150/100, 106, 114; 446/397; 40/455, 906

[56] References Cited

U.S. PATENT DOCUMENTS

| | | | |
|---|---|---|---|
| 2,218,396 | 10/1940 | Hallbauer | 150/106 |
| 2,513,013 | 6/1950 | Feldman | 150/106 |
| 3,045,900 | 7/1962 | Zekendorf | 150/106 |
| 3,144,065 | 8/1964 | Burgio, Jr. | 150/106 |
| 3,798,806 | 3/1974 | Sanford | 40/455 |
| 4,050,493 | 9/1977 | Cho | 150/106 |
| 4,607,747 | 8/1986 | Steiner | 40/455 |
| 4,960,233 | 10/1990 | Morchower | 150/106 |
| 5,063,698 | 11/1991 | Johnson et al. | 40/455 |

FOREIGN PATENT DOCUMENTS

| | | | |
|---|---|---|---|
| 1356204 | 2/1964 | France | 150/100 |
| 2613863 | 10/1988 | France | 40/906 |

*Primary Examiner*—Gary E. Elkins

*Attorney, Agent, or Firm*—Amster, Rothstein & Ebenstein

[57] ABSTRACT

A diaperbag includes a utility bag for storage and transport of baby paraphernalia, the utility bag defining at least one compartment configured and dimensioned to receive baby paraphernalia therein. An actuatable electronic sound chip for generating sound is secured to the bag. A switch is provided for actuating the chip, the switch being permanently secured to the bag and in operative communication with the chip. In a preferred embodiment, the bag includes a closure for the compartment, the closure being manually movable between an opening orientation enabling free access to the compartment and a closing orientation limiting free access to the compartment. The switch and closure are constructed, configured and dimensioned such that manual movement of the closure from the closing orientation to the opening orientation is normally sufficient to cause the switch to actuate the chip.

7 Claims, 1 Drawing Sheet

DIAPERBAG

BACKGROUND

The present invention relates to a diaperbag and more particularly to a diaperbag which can generates sound.

The diaperbag is a utility bag intended for the storage and transport of baby paraphernalia, including typically such items as diapers, baby powder, baby oil, feeding bottles, blankets, and the like Typically the bag includes a plurality of compartments configured and dimensioned to receive baby paraphernalia therein Some of the compartments are typically permanently open (that is, accessible) so as to facilitate use thereof, while others are typically closable by means of zippers, snap locks, microhook/microloop fasteners (of the type sold under the tradename VELCRO), and the like.

As a baby is usually in distress immediately prior to a diaper change, and the process of changing the diaper may itself be sufficient to put the changer in a condition of stress, it would be desirable for soothing sounds such as music (or even intra-uterine sounds similar to those heard by the child in the womb) to be played during use of the diaperbag. In particular instances a sound-generating system (e.g., a radio, tape, stereo or CD system) may not be readily available at the time and location of the diaper change. Thus there exists a need for a diaperbag which includes a sound-generating system so that the same is readily available for use with the diaperbag.

Preferably the soothing sounds would start about when a diaper is removed from a compartment of the diaperbag for a diaper-change. However, despite the beneficial effects of such sounds on both the baby and the changer, during the rush of preparing to change the diaper, the changer may neglect to actuate the sound-generating system. Although the sound-generating system is available and readily adjacent the diaperbag (for example, disposed in or on the diaperbag), the changer may simply forget to actuate the sound-generating system, being more concerned at the instant with pacifying the crying baby and preventing undue contamination of the area by the baby's exudate.

Accordingly, it is an object of the present invention to provide a diaperbag having as a part thereof actuatable electronic means for generating sound.

Another object is to provide such a diaperbag including switch means for actuating the sound-generating means, the switch means in a preferred embodiment being so constructed, configured and dimensioned that accessing of a predetermined compartment of the diaperbag is normally sufficient to actuate the sound-generating means.

A further object is to provide such a diaperbag in which, depending upon the desired application, closure of the compartment either is or is not normally sufficient to cause the switch means to again actuate the sound-generating means.

SUMMARY OF THE INVENTION

It has now been found that the above and related objects of the present invention are obtained in a diaperbag comprising utility bag means for storage and transport of baby paraphernalia, actuatable electronic means for generating sound, and switch means for actuating the sound-generating means. The sound-generating means is secured to the bag means, and the switch means is secured to the bag means and in operative communication with the sound-generating means.

In a preferred embodiment, the bag means defines at least one compartment configured and dimensioned to receive baby paraphernalia therein and closure means for the compartment. The closure means is manually movable between an opening orientation enabling free access to the interior of the compartment and a closing orientation limiting free access to the interior of the compartment. The closure means and the switch means are constructed, configured and dimensioned such that manual movement of the switch means from the closing orientation to the opening orientation is normally sufficient to cause the switch means to actuate the sound-generating means.

Preferably the switch means and the sound-generating means are secured together for movement as a unit, and optimally both are disposed on the closure means for movement as a unit therewith.

Depending on the intended application, the closure means and the switch means are constructed, configured and dimensioned such that manual movement of the switch means from the opening orientation to the closing orientation is or is not normally sufficient to cause the switch means to actuate the sound-generating means.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing.

DETAILED DESCRIPTION OF THE PREFERRED EMBODIMENTS

Figure 1:
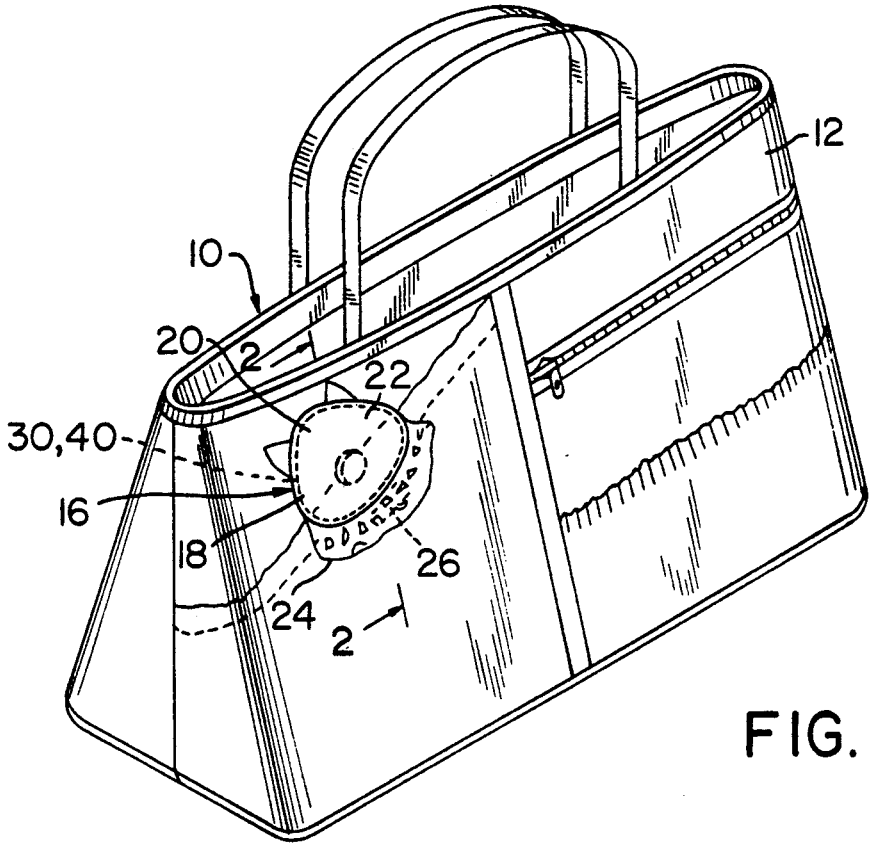
FIG. 1 is an isometric view of a diaperbag according to the present invention, with a flap precluding access to the interior of a compartment thereof.

Referring now to FIG. 1, therein illustrated is a diaperbag according to the present invention, generally designated by the reference numeral 10. The diaperbag 10 comprises a standard utility bag 12 of the type conventionally used for the storage and transport of baby paraphernalia (not shown), the bag 12 defining at least one compartment 14 configured and dimensioned to receive baby paraphernalia therein such as diapers, feeding bottles, baby powder, baby oil, and the like. The compartment 14 may be the main compartment of the bag 12, but is illustrated in FIG. 1 as being a secondary smaller compartment disposed on an exterior surface of the bag 12. The bag 12, and in particular compartment 14, may be formed substantially of any of the materials conventionally used for such bags, including plastic, textiles, combinations thereof, and the like.

The compartment 14 is provided with a closure generally designated 16. The closure 16 is movable between a first or opening orientation enabling free access to the interior of the compartment 14 (see the phantom line illustration of FIG. 2) and a second or closing orientation limiting free access to the interior of the compartment 14 (see FIG. 1 and the solid line illustration of FIG. 2). The closure 16 is typically a flap 18 (as illustrated) which covers an open edge (e.g., the top) of the compartment 14, but may alternatively be a zipper, button, or a like releasable closure. It is not necessary that the closure 16 effects a complete closure of the compartment 14, but merely that the closure 16 limits free access thereto and would normally be moved from the closing orientation to the opening orientation by one wishing to access the interior of the compartment.

As illustrated, one edge 20 of the flap 18 is permanently secured to the outer surface of the bag 12 adjacent compartment 14 (e.g., by a sewn seam 22, as illustrated) in such a manner that a portion of the flap 18 normally extending over the opening of compartment 14 can be raised away from the outer surface of the compartment 14 or otherwise moved away from the compartment 14 (for example, if the connection is by a pivot pin, by pivoting the flap 18 so as to permit free access to the interior of the compartment 14). Another edge 24 of the flap 18 (typically an edge opposite edge 20) is releasably secured to the outer surface of the compartment 14 by a releasable fastener 26 (such as a snap fastener, a microhook/microloop assembly of the type sold under the tradename VELCRO (as illustrated), or the like) so as to enable easy manual separation of the flap edge 24 from the outer surface of the compartment 14, thereby enabling free access to the interior of the compartment 14 through the opening. It will be readily appreciated by those skilled in the art that, alternatively, the flap 18 could be permanently secured to the outer surface of the compartment 14 and releasably secured to the outer surface of the bag 12 with the same result that, depending upon the status of the releasable fastener 26, free access to the interior of the compartment 14 is either enabled or limited. Further, while the compartment 14 is illustrated as having an open top which is releasably closable by the closure 16, clearly the compartment 14 may have a side opening rather than a top opening, with the closure 16 then releasably closing the side opening.

Actuatable electronic means 30 for generating sound is secured to the bag 12. The sound-generating means 30 is typically a conventional sound-generating chip of the type well known in the electronic arts and used in a variety of toys, appliances and the like. Depending upon the nature of the sound-generating means 30, it may simply replay (albeit possibly in modified sequence) prerecorded sounds or it may actually generate sounds (which would not be prerecorded). Typically the sound-generating means 30, once actuated, continues to generate the sound for a predetermined period of time or until the playing of a particular piece (e.g., a song) is completed. As will be appreciated by those skilled in the art, the sound-generating means 30 may be used to generate music (for this application, preferably soothing music or a lullaby), voice, or the like. Indeed, if desired, the chip 30 may be used to generate a soothing intra-uterine sound resembling the sounds heard by a baby in the womb.

Switch means 40 are provided for actuating the sound-generating means 30, the switch 40 being permanently secured to the bag 12 and in operative communication with the sound-generating means 30. According to a preferred embodiment of the present invention, it is critical that the switch 40 is constructed, configured and dimensioned such that manual movement of a predetermined closure 16 (i.e., flap 18) from the closing orientation to the opening orientation is normally sufficient to cause the switch 40 to actuate the sound-generating means 30. In the preferred embodiment illustrated, the sound-generating means 30 and the switch 40 are secured together for movement as a unit, both being disposed on and actually within the flap 18 for movement as a unit therewith. Thus the switch 40 may simply be of the pressure-actuated type well known in the switch art, such that grasping of the closure 16 in order to move it from its closing orientation to its opening orientation will normally cause sufficient pressure to be applied to the switch that it, in turn, actuates the sound-generating means 30. The flap 18 may bear on its outer surface either an express legend in words indicating the presence of the switch 40 ("SWITCH") or the method of operating the same ("PRESS HERE!"), or the same effect may be obtained through the use of graphics without words.

In order to ensure that the grasping of the closure means 16 is normally sufficient to actuate the switch 40, the closure means 16 and the switch 40 must be constructed, configured and dimensioned to that end—in other words, so that the user normally places his or her fingers in the correct position to contact and activate the switch 40 as part of the flap-lifting process. For example, the portion of the flap 18 which is normally grasped by the user may be of such small area or so located that the user invariably contacts the pressure-sensitive surface of the switch 40. Where the closure means 16 is not a flap 18, but a zipper or the like, the sound-generating means and switch may be disposed elsewhere on the bag 12, but with the switch 40 responsive to the position of the zipper locking element, such that, when the zipper is closed (i.e., the locking element is against one end of the zipper), the switch is deactivated, and, when the zipper is open (i.e., the locking element is spaced from that one end), the switch is activated. In such a case, the locking element of the zipper may itself be a part of the switch.

In either instance, it will be appreciated that the switch 40 may be activated, thereby actuating the sound-generating means 30, without permitting free access to the interior of the compartment 14. In the case of a flap 18, the flap 18 may simply be squeezed at an appropriate point, without being moved from its closing orientation to its opening orientation, this being sufficient to activate the switch 40. In the case of a zipper, the locking element may be moved only a slight distance away from the one end, a distance sufficient to activate the switch without permitting free access to the interior of the compartment.

When the diaperbag 10 of the present invention is used, the very act of opening the closure 16 so as to access the compartment 14 (as illustrated in phantom line in FIG. 2) will normally be sufficient to activate switch 40, and hence actuate the sound-generating means 30, so that the person using the diaperbag does not have to especially remember to turn on the soothing music or take any special action with respect thereto beyond the normal accessing of the compartment. After the baby is changed and the baby paraphernalia is returned to the diaperbag 10, normally the compartment will be closed by the user so that the next time the user accesses the compartment he or she will again activate the switch 30, and hence the sound-generating means 40.

Figure 2:
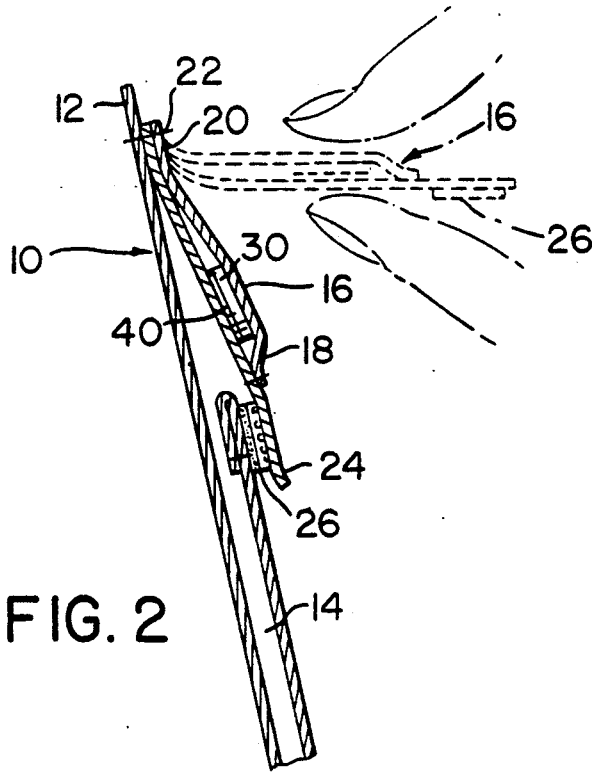
FIG. 2 is a fragmentary sectional view taken along the line 2—2 of FIG. 1, with the flap being illustrated in phantom line as being raised by fingers to enable access to the interior of the compartment.

If desired, the closure 16 can be designed such that its movement from the opening orientation to the closing orientation will not normally activate the switch 40 to actuate the sound-generating means 30 since at this point the baby has already been changed and there is no need for soothing music to be produced. This can be easily effectuated by placing the switch 40 in a position where it is contacted and pressure is applied thereto when the flap 18 is being raised (moved to the opening orientation), but not when the flap is being lowered (moved to the closing orientation). Alternatively, as illustrated in FIG. 2, the switch 40 may be sensitive to pressure applied to only one surface thereof, that surface being the undersurface of the flap 18 which has pressure applied thereto primarily when the flap is being raised, and not the oversurface of the flap 18 which has pressure applied thereto primarily when the flap is being lowered. However, if desired, the closure means 16 can be designed such that movement thereof from the opening orientation to the closing orientation will normally activate the switch means 40 to actuate the sound-generated means 30—e.g., by utilization of a switch means 40 which is sensitive to pressure applied to either side of flap 18 (both the undersurface and oversurface thereof).

It will be appreciated that, while the normal opening of the compartment (that is, moving the flap 18 to the opening orientation) will be sufficient to actuate the switch 40, and hence actuate the sound-generating means 30, the switch 40 may also be actuated without moving the flap 18 from one orientation to another. For example, the user may simply grasp the flap 18 in such a manner that a suitable level of pressure is applied to the appropriate surface to activate the switch 40, and hence actuate the sound-generating means 30. In this instance, of course, it is not essential that the switch 40 and sound-generating means 30 be disposed on the flap 18 (or other closure 16), and they may simply be disposed on a conveniently accessible portion of bag 12 for the user to activate when and if he/she feels appropriate. Of course, in this instance the automatic turn-on feature of the diaperbag 10 is lost, and the user must remember to make the necessary effort to activate the switch 40 and hence actuate the sound-generating means 30. Nonetheless, in particular applications such an embodiment may be preferred as the user retains more complete control over if and when the sound-generating system is to be actuated.

In particular applications, if desired, the sound-generating means 30, once actuated by activation of switch 40, may continue to play only so long as the switch 40 is continuously activated (e.g., pressed) and may automatically shut itself off once the switch 40 is deactivated (e.g., pressure on the switch released), thereby affording the user a greater degree of control over the duration of the sound. In such circumstances, because typically the user is not able to spare a finger to apply continued pressure to a pressure-actuated switch, it may be desirable to use a bipolar switch (which must be manually moved between a stable on/activated position and a stable off/deactivated position) or a special pressure switch which is activated by the first application of pressure thereto and deactivated by the second application of pressure thereto. Each of such switches is well known in the switching art and hence need not be set forth in further detail herein.

To summarize, the present invention provides a diaperbag having as a part thereof actuatable electronic means for generating sound. The diaperbag includes switch means for actuating the sound-generating means, the switch means preferably being so constructed, configured and dimensioned that accessing of a particular compartment of the diaperbag is normally sufficient to actuate the sound-generating means. Depending upon the desired application, closure of the compartment either is or is not normally sufficient to cause the switch means to again actuate the sound-generating means.

Now that the preferred embodiments of the present invention have been shown and described in detail, various modifications and improvements thereon will become readily apparent to those skilled in the art. Accordingly, the spirit and scope of the present invention are to be construed broadly and limited only by the appended claims, and not by the foregoing disclosure.

I claim:

1. A diaperbag comprising:

(A) utility bag means for storage and transport of baby paraphernalia;

(B) actuatable electronic means for generating sound, said sound-generating means being secured to said bag means; and (C) switch means for actuating said sound-generating means, said switch means being secured to said bag means and in operative communication with said sound-generating means.

2. The diaperbag of claim 1 wherein said bag means defines at least one compartment configured and dimensioned to receive baby paraphernalia therein and closure means for said compartment, said closure means being manually movable between an opening orientation enabling free access to the interior of said compartment and a closing orientation limiting free access to the interior of said compartment, said closure means and said switch means being constructed, configured and dimensioned such that manual movement of said switch means from said closing orientation to said opening orientation is normally sufficient to cause said switch means to actuate said sound-generating means.

3. The diaperbag of claim 2 wherein said closure means and said switch means are constructed, configured and dimensioned such that manual movement of said switch means from said opening orientation to said closing orientation is normally sufficient to cause said switch means to actuate said sound-generating means.

4. The diaperbag of claim 2 wherein said closure means and said switch means are constructed, configured and dimensioned such that manual movement of said switch means from said opening orientation to said closing orientation is normally not sufficient to cause said switch means to actuate said sound-generating means.

5. The diaperbag of claim 2 wherein said switch means and sound-generating means are both disposed on said closure means for movement as a unit therewith.

6. The diaperbag of claim 1 wherein said switch means and said sound-generating means are secured together for movement as a unit.

7. A diaperbag comprising:

(A) utility bag means for storage and transport of baby paraphernalia, said bag means defining at least one compartment configured and dimensioned to receive baby paraphernalia therein and closure means for said compartment, said closure means being manually movable between an opening orientation enabling free access to the interior of said compartment and a closing orientation limiting free access to the interior of said compartment;

(B) actuatable electronic means for generating sound, said sound-generating means being secured to said bag means; and (C) switch means for actuating said sound-generating means, said switch means being secured to said bag means and in operative communication with said sound-generating means;

said closure means and said switch means being constructed, configured and dimensioned such that manual movement of said switch means from said closing orientation to said opening orientation is normally sufficient to cause said switch means to actuate said sound-generating means; said switch means and sound-generating means both being disposed on said closure means for movement as a unit therewith.

* * * * *